US005937579A

United States Patent [19]

Baczewski et al.

[11] Patent Number: 5,937,579

[45] Date of Patent: Aug. 17, 1999

[54] AUTOMATIC DOOR OPENER

[76] Inventors: Gary L. Baczewski, 322 Harriett, San Antonio, Tex. 78216; Dennis Aguilar, 1200 Silber Rd., Houston, Tex. 77055

[21] Appl. No.: 08/838,165

[22] Filed: Apr. 16, 1997

[51] Int. Cl.[6] ..... E05F 15/02

[52] U.S. Cl. ..... 49/28; 49/199

[58] Field of Search ..... 49/138, 339, 340, 49/341, 324, 360, 26, 27, 28, 197, 199

[56] References Cited

U.S. PATENT DOCUMENTS 3,921,335 11/1975 Hewitt et al. ..... 49/138 X
3,938,282 2/1976 Goyal ..... 49/138 X
5,203,110 4/1993 Hormann ..... 49/28

*Primary Examiner*—Jerry Redman
*Attorney, Agent, or Firm*—Christopher L. Makay

[57] ABSTRACT

A door opener includes a motor in mechanical communication with a door, a first gas source for powering the motor, and a control system interposed to the first gas source and the motor. The control system includes a first pilot valve communicating with the first gas source at an inlet port and the motor at a motor port. The first pilot valve also communicates with a first flow control valve at an exhaust port. The first flow control valve regulates the speed of the door during closing and communicates with the first pilot valve at an inlet port and communicates with the atmosphere at an exhaust port.

17 Claims, 4 Drawing Sheets

AUTOMATIC DOOR OPENER

BACKGROUND OF THE INVENTION

1. Field of the Invention

The present invention relates to door openers, and more particularly, but not by way of limitation, to a door opener having a gas-powered control system.

2. Description of the Related Art

Environmental concerns have created a demand for motor vehicles powered by a fuel other than gasoline. One such alternative fuel for motor vehicles is natural gas. However, natural gas is a safety hazard because it forms a highly explosive mixture with air. In an enclosed structure, such as a garage, this mixture is susceptible to ignition. Therefore, it is highly desirable to eliminate ignition sources in enclosed structures to prevent the mixture from exploding.

In garages, ignition sources include electric garage door openers which may spark thereby igniting flammable gases in the air. One solution to eliminate this ignition source requires using a garage door opener with an explosion proof motor. However, due to their cost, many garage owners cannot afford an explosion proof motor.

Another solution replaces the electric door motor with a pneumatic door motor. One such door opener design is disclosed in U.S. Pat. No. 4,891,908, issued Jan. 9, 1990, to Aquilina. Aquilina uses a door opener with a pneumatic motor, however, electrical components stop or reverse the door if objects jam underneath the door during closing.

Another door opener with a pneumatic motor is disclosed in U.S. Pat. No. 4,417,418, issued Nov. 29, 1983, to Warning. The Warning motor includes two pistons that are housed within respective cylinders and moved by pressurized air to raise and lower the door. A back pressure within the cylinders slows the door at the end of its travel during opening and closing. In addition, an electrical system controls the operation of the garage door.

Still another pneumatic door opener is disclosed in U.S. Pat. No. 3,921,335, issued Nov. 25, 1975, to Hewitt et al. The pneumatic door opener has a pneumatic control scheme that activates a back pressure that slows the door's opening and closing. A pneumatic sensing means opens a valve that releases back pressure depending upon the position of the door.

The use of these pneumatic door openers suffers several disadvantages. Aquilina and Warning utilize electronic controls to detect obstructions during closing and when the door reaches its operational limits. Consequently, these door openers provide an electrical ignition source that may cause a natural gas explosion. Hewitt, et al. eliminate electronic controls, however, the disclosed pneumatic control fails to stop or reverse the door if the door encounters an obstruction during closing.

Accordingly, a pneumatic door opener having a pneumatic control system with door stopping and reversing capabilities improves operability and safety over conventional pneumatic door openers.

SUMMARY OF THE INVENTION

In accordance with the present invention, a door opener includes a motor in mechanical communication with a door, a first gas source for powering the motor, and a control system interposed to the first gas source and the motor. The control system includes a first pilot valve communicating with the first gas source at an inlet port and the motor at a motor port. The first pilot valve also communicates with a first flow control valve at an exhaust port. The first flow control valve regulates the speed of the door during closing and communicates with the first pilot valve at an inlet port and the atmosphere at an exhaust port.

Another embodiment of the present invention is a door opener that includes a motor in mechanical communication with a door, a first gas source for powering the motor, and a control system interposed to the first gas source and the motor. The control system includes a sensor valve that transmits a gas signal to stop and reverse the closing of the door. The door opener further includes a second air source, a first pilot valve, a second pilot valve, a third pilot valve, a fourth pilot valve, and a fifth pilot valve. The second air source communicates with the sensor valve. The first pilot valve communicates with the first gas source at an inlet port and the motor at a motor port. The second pilot valve communicates with the first gas source at an inlet port and the motor at a motor port. The third pilot valve communicates with the second gas source at an actuator port and with the first air source at an inlet port. The fourth pilot valve communicates with the second gas source at an inlet port and the first pilot valve at an outlet port, and releases a signal to stop and reverse the closing of the door. The fifth pilot valve communicates with the second gas source at a first actuator port and the first air source at an inlet port.

It is, therefore, an object of the present invention to provide a pneumatic powered door opener with a pneumatic control scheme.

Another object of the present invention is to provide a pneumatic control scheme that stops the door during closing if the door encounters an obstruction.

A further object of the present invention is to provide a pneumatic control scheme that reverses the door during closing if the door encounters an obstruction.

Still other objects, features, and advantages of the present invention will become evident to those of ordinary skill in the art in light of the following.

BRIEF DESCRIPTIONS OF THE DRAWINGS

DETAILED DESCRIPTION OF THE PREFERRED EMBODIMENT

Figure 1:
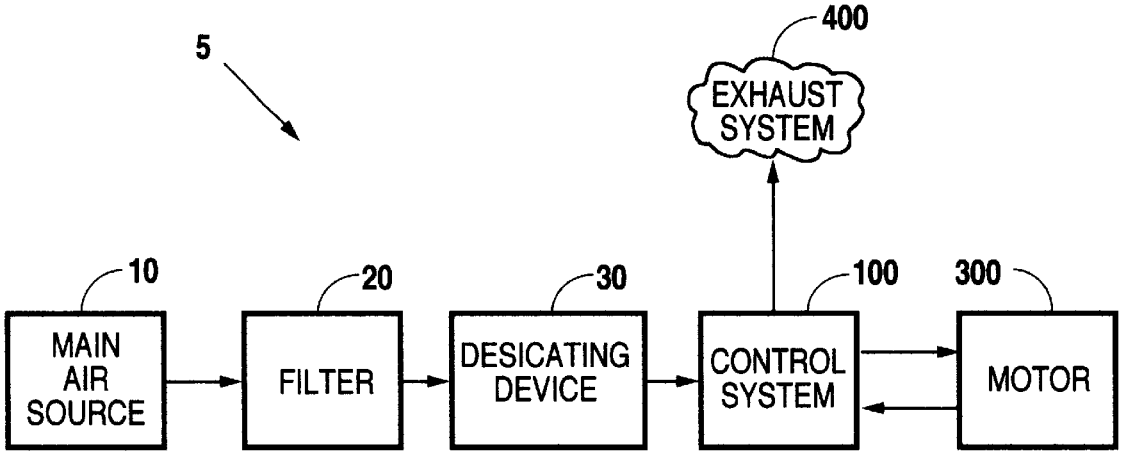
FIG. 1 is a block diagram illustrating the main components of a pneumatic door opener of the present invention.
Figure 2:
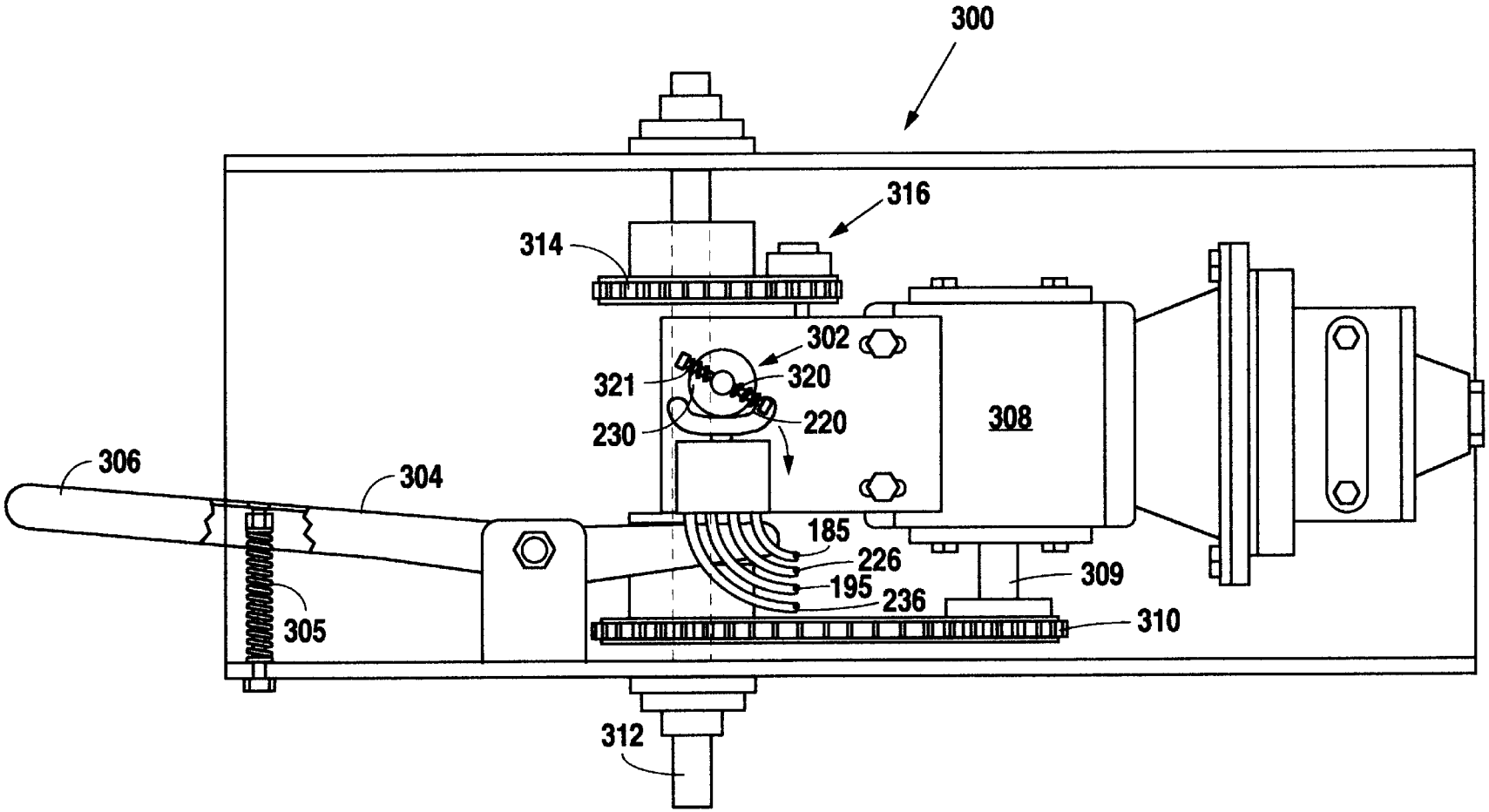
FIG. 2 is a top, plan view illustrating the motor of the pneumatic door opener.
Figure 3:
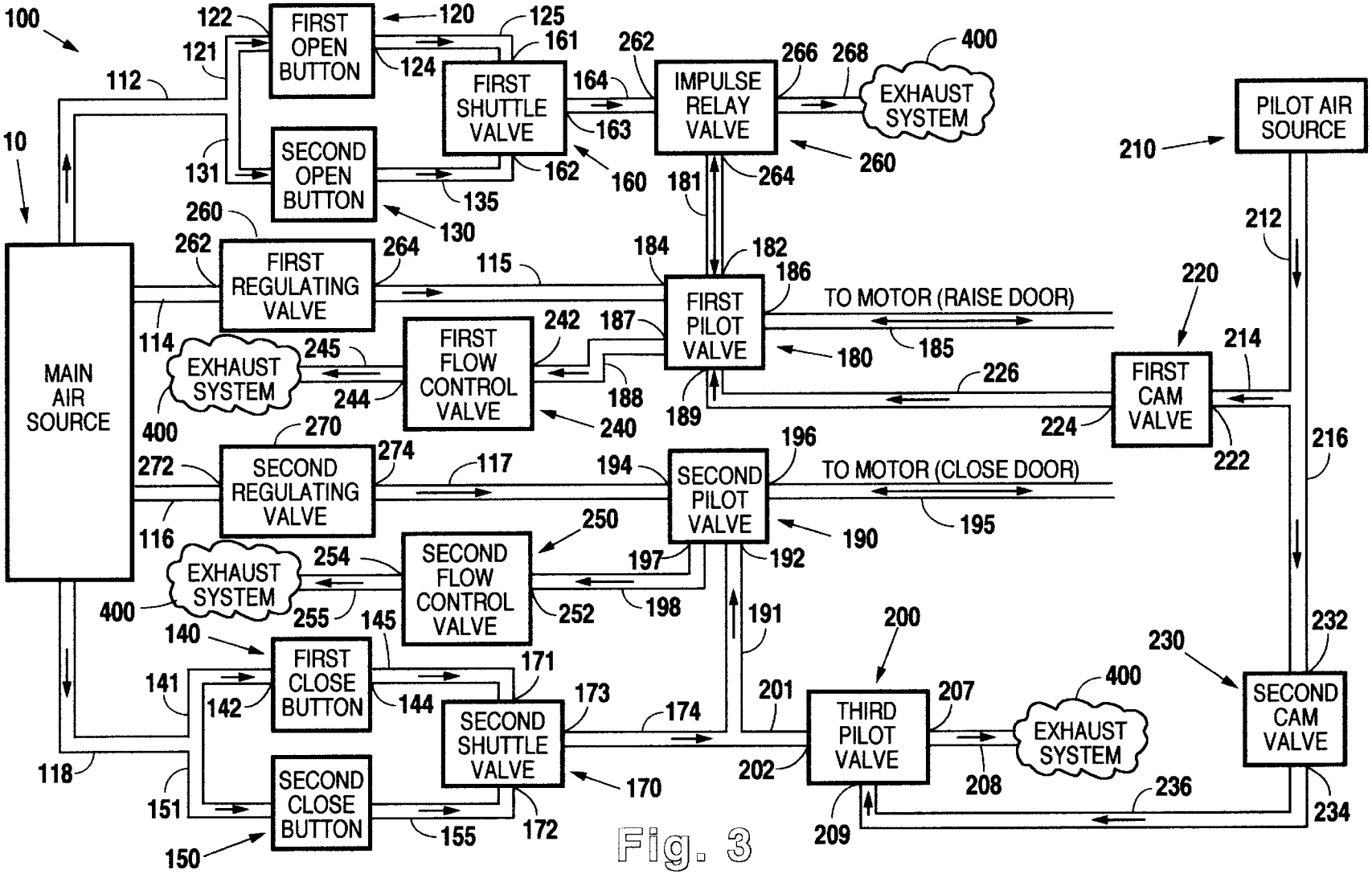
FIG. 3 is a block diagram illustrating a first preferred embodiment of the control system of the pneumatic door opener.

As illustrated in FIGS. 1–3, a pneumatic door opener 5 includes a filter 20, a desiccating device 30, a control system 100, and a motor 300. A first or main air source 10 supplies air that passes through the filter 20 en route to the control system 100. Although in this preferred embodiment one air source 10 is utilized, multiple air sources may be used. Furthermore, gases other than air may be used. The filter 20 filters the air and adds oil that lubricates the valves of the control system 100. The filter 20 and desiccating device 30 respectively remove particles and moisture that may cause the valves of the control system 100 to stick. The-air enters the control system 100 to initiate and then control door operation by powering the motor 300, which opens and closes the door.

Preferably, the motor 300 is a GAST 4AM-NRV-50C motor manufactured by Gast, P.O. Box 97, Benton Harbour, Mich. 49023-0097. The motor 300 includes a cam 302, a manual override bar 304, a gear box 308, a first driveshaft 309, a first chain 310, a second driveshaft 312, a second chain 314, and a third driveshaft 316. The air from the main air source 10 enters the motor 300 and turns its vanes which communicate with the gear box 308. The gear box 308, in turn, is in communication with the first driveshaft 309. As the driveshaft 309 rotates, it engages the first chain 310 which, in turn, rotates the second driveshaft 312. The second driveshaft 312 connects to a pulley operated overhead door. One of ordinary skill in the art will readily recognize that this connection can be designed for any kind of door. The second driveshaft 312 also engages and rotates the second chain 314 which, in turn, connects to the third driveshaft 316 to rotate the cam 302. The cam 302 stops the opening and closing of the door (described herein).

A manual override bar 304 including a spring 305 and a handle 306 terminates communication between the driveshaft 312 and the first chain 310, thereby permitting manual door operation. The driveshaft 312 has a slideable gear that interacts with a corresponding gear, which engages the chain 310. Grasping the handle 306 compresses the spring 305 and slides the driveshaft's gear along a slot on the driveshaft 312. This movement disengages the driveshaft gear from the chain gear to terminate the communication between the driveshaft 312 and the first chain 310. However, moving the door still rotates the driveshaft 312 which, in turn, communicates with the cam 302 via the chain 314 and driveshaft 316. As a result, the cam 302 corresponds to the positioning of the door during manual operation. Releasing the handle 306 reestablishes communication between the driveshaft 312 and the chain 310.

The control system 100 includes a first open button 120, a second open button 130, a first close button 140, a second close button 150, a first shuttle valve 160, and a second shuttle valve 170. The buttons 120, 130, 140, and 150 are preferably push-button operated valves of the type REXROTH H894040-9902 manufactured by Rexroth, P.O. Box 13597, Lexington, Ky. 40512-3701. The first shuttle valve 160 and the second shuttle valve 170 are preferably REXROTH P54350-2 valves manufactured by Rexroth, P.O. Box 13597, Lexington, Ky. 40512-3701.

The control system 100 also includes an impulse relay valve 260, a first pilot valve 180, a second pilot valve 190, a third pilot valve 200, a first flow control valve 240, and a second flow control valve 250. The impulse relay valve 260 is preferably a 414B Pressure Type valve manufactured by Mead, 4114 N. Knox Ave., Chicago, Ill. 60641. Preferably, the pilot valves 180, 190, and 200 are, respectively, REXROTH GT 10050-3333-P69191-1, GT 10050-3340-P69191-1, and GC 15000-3355 valves manufactured by Rexroth, P.O. Box 13597, Lexington, Ky. 40512-3701. The flow control valves 240 and 250 are preferably MMS-250 valves manufactured by Mead, 4114 N. Knox Ave., Chicago, Ill. 60641.

In addition, the control system 100 includes a first regulating valve 260 and a second regulating valve 270. The supply control valves 260 and 270 are R352G valve manufactured by ARROW, 500 Oakwood Road, Lake Zurich, Ill. 60047.

The control system 100 further includes a first cam valve 220 and a second cam valve 230. The cam valves 220 and 230 are REXROTH HH 563260-0000 valves preferably manufactured by Rexroth, P.O. Box 13597, Lexington, Ky. 40512-3701.

The buttons 120 and 130, the first shuttle valve 160, impulse relay valve 260, and first pilot valve 180 activate the opening of the door. The first open button 120 and the second open button 130 are respectively positioned inside and outside of the enclosed structure, such as a garage. A line 112 branches into lines 121 and 131 that connect the main air source 10 with the buttons 120 and 130. Lines 125 and 135 connect respective buttons 120 and 130 to the first shuttle valve 160. A line 164 connects the first shuttle valve 160 with the impulse relay valve 260. A line 268 connects the impulse relay valve 260 with an exhaust system 400 at atmospheric pressure. The exhaust system 400 is a network of piping that may include scrubbers to clean the added oil from the air prior to venting to the atmosphere. A line 181 connects the impulse relay valve 260 with the first pilot valve 180.

Several lines connect the first pilot valve 180 to the other components of the control system 100. A line 115 connects the first pilot valve 180 with a first regulating valve 260 which, in turn, communicates with the main air source 10 via a line 114. The first regulating valve 260 controls the pressure of the air received by the first pilot valve 180 from the main air source 10. A line 185 connects the pilot valve 180 for facilitating the supply of air to and the receipt of air from the motor 300. A line 188 connects the pilot valve 180 to the flow control valve 240. The flow control valve 240 regulates the rate at which the door closes by controlling the exhaust rate of the air from the motor 300. A line 245 connects the flow control valve 240 to the exhaust system 400.

To stop the opening of the door, lines 212 and 214 connect a second or pilot air source 210 with the first cam valve 220. The air source 210 is preferably air, although other gases may be used. A line 226 connects the first cam valve 220 with the first pilot valve 180. The opening of the valve 220 delivers air to the pilot valve 180 thereby stopping the opening of the door (described herein).

The buttons 140 and 150, the second shuttle valve 170, and the second pilot valve 190 activate the closing of the door. The first close button 140 and the second close button 150 are respectively positioned inside and outside of the enclosed structure. A line 118 branches into lines 141 and 151 to connect the main air source 10 with the buttons 140 and 150. Lines 145 and 155 connect respective buttons 140 and 150 to the second shuttle valve 170. The line 174 branches into the line 191 to connect the second shuttle valve 170 with the second pilot valve 190. Similarly, the line 174 branches into the line 201 to connect the second shuttle valve 170 with the third pilot valve 200.

Several lines connect the second pilot valve 190 with other components of the control system 100. A line 117 connects the second pilot valve 190 to a second regulating valve 270 which, in turn, communicates with the main air source 10 via a line 116. The second regulating valve 270 controls the pressure of the air received by the second pilot valve 190 from the main air source 10. A line 195 connects the pilot valve 190 to the motor 300 for facilitating the supply of air to and receipt of air from the motor 300. A line 198 connects the second pilot valve 190 to the second flow control valve 250 for controlling the flow of air exiting the motor 300 during door opening. A line 255, in turn, connects the second flow control valve 250 to the exhaust system 400.

To stop the closing of the door, the second cam valve 230 and third pilot valve 200 are activated. Lines 212 and 216 connect the second cam valve 230 with the pilot air source 210 to supply air from the pilot air source 210 to the second cam valve 230. A line 236 connects the valve 230 to the third pilot valve 200. A line 208 connects the valve 200 to the exhaust system 400 for exhausting air from the line 174.

To open the door, an operator pushes either the button 120 or 130. Because the structure and operation of the buttons 120 and 130 are substantially identical, only the button 120 will be described. The button 120 has an inlet port 122 and outlet port 124. The button 120 also includes a spring and a piston having a passageway therethrough. The spring biases the piston to offset the passageway with the ports 122 and 124 preventing air from the main air source 10 from reaching the first shuttle valve 160. Pressing the button 120 moves the piston, which depresses the spring, to align the passageway with the inlet port 122 and outlet port 124. After release of the button 120, the spring expands moving the piston to offset the passageway relative to the ports 122 and 124, thereby closing the line 121. An air pulse from the line 121 travels through the line 125 to the first shuttle valve 160.

The first shuttle valve 160 includes first and second inlet ports 161–162 and outlet port 163. The air pulse enters the inlet port 161 and forces a diaphragm within the valve 160 to block the inlet port 162. The air pulse then exits the outlet port 163 to travel to the impulse relay valve 260 through the line 164.

The impulse relay valve 260 includes an inlet port 262, actuator port 264, and an exhaust port 266. The impulse relay valve 260 also includes a piston having a passageway therethrough. The air pulse enters the inlet port 262 and exits through the actuator port 264 to activate the first pilot valve 180. Almost simultaneously, the air pulse builds pressure within the valve 260 to open an internal spring-loaded valve. opening the spring-loaded valve permits a slipstream from the air pulse to shift the piston, thereby aligning the passageway with the lines 181 and 268. This alignment exhausts air from the line 181 to the exhaust system 400 and eliminates any back pressure on the first pilot valve 180.

The air pulse travels through the line 181 to shift the pilot valve 180. The first pilot valve 180 includes a first actuator port 182, an inlet port 184, a motor port 186, an exhaust port 187, and a second actuator port 189. The first pilot valve 180 also includes a piston having a passageway therethrough. The air pulse enters the pilot valve 180 through the actuator port 182 shifting the piston to align the passageway with the ports 184 and 186. This alignment communicates the main air source 10 with the motor 300 for opening the door. Because the piston of the valve 180 is unbiased by any mechanism, such as a spring, momentarily depressing either button 120 or 130 aligns the passageway with the ports 184 and 186.

Aligning the passageway in the first pilot valve 180 permits air from the main air source 10 to travel through the line 114 to the first regulating valve 260. The first regulating valve 260 has an inlet port 262 and an outlet port 264. After the air enters the inlet port 262, the valve 260 controls the pressure of the air exiting the outlet port 264. The air then travels from the outlet port 264 through the line 115 to the first pilot valve 180. Due to the alignment of the passageway with the ports 184 and 186, air travels through the first pilot valve 180 and the line 185 to the motor 300. The air from the line 185 enters the motor 300 to turn the vanes for raising the door.

The second pilot valve 190 includes an actuator port 192, an inlet port 194, a motor port 196, and an exhaust port 197. The second pilot valve 190 also includes a spring and a piston having a passageway therethrough. The spring biases the piston to align the passageway with ports 196 and 197. During the opening of the door, air supplied to the motor 300 through the line 185 exhausts through the line 195. The motor exhaust air from the line 195 enters the motor port 196 of the valve 190, travels through the passageway, and exits through the exhaust port 197. The motor exhaust air then travels through the line 198 to the second flow control valve 250.

The second flow control valve 250 includes an inlet port 252 and outlet port 254. The motor exhaust air enters the inlet port 252 and exits the outlet port 254. The second flow control valve 250 is adjustable to regulate the flow rate of the motor exhaust air. Controlling the flow rate of the motor exhaust air regulates the speed at which the motor rotates, and thus controls the rate at which the door opens. The exhaust air travels from the exhaust port 254 through the line 255 to the exhaust system 400.

As the door opens, the second driveshaft 312 rotates the chain 314 which, in turn, rotates the cam 302 via the third driveshaft 316. As a result, the positioning of the cam 302 corresponds to the positioning of the door as it opens. Once the door has reached its fully open position, an arm 320 of the cam 302 depresses the first cam valve 220, thereby activating it.

The first cam valve 220 includes an inlet port 222 and an outlet port 224. The first cam valve 220 also includes a spring and a piston having a passageway therethrough. The spring biases the piston to offset the passageway with respect to ports 222 and 224, thereby closing the line 214. Once the door fully opens, the arm 320 depresses the valve 220 moving the piston, which compresses the spring, to align the passageway with the ports 222 and 224. This alignment permits air from the pilot air source 210 to travel through lines 212, 214 and 226 to the first pilot valve 180.

The air from the pilot air source 210 enters the valve 180 through the second actuator port 189. The air entering the port 189 shifts the first pilot valve 180 to disrupt the communication between lines 115 and 185 by shifting the piston to align the passageway with lines 185 and 188. This shifting of the piston shuts off the supply of air to the motor 300, thereby stopping it, and aligns the line 185 with the exhaust system 400. The shifting of the valve 180 also forces out the air within the line 181. The air from the line 181 enters the actuator port 264 of the impulse relay valve 260, exits through the exhaust port 266, and travels through the line 268 to the exhaust system 400. A slipstream taken from the forced air shifts the piston to disrupt the communication between the lines 181 and 268 by aligning the passageway within the piston with lines 164 and 181. The positioning of the door corresponds to the positioning of the cam 302 that continues to depress the valve 220 with the arm 320, thereby sending air to the actuator port 189 of the first pilot valve 180. By maintaining pressure on the actuator port 189, this positioning prevents further opening of the door if either of the buttons 120 or 130 is accidentally pressed. Once either of the closed buttons 140 or 150 is pushed, the cam 302 rotates moving the arm 320. The arm 320 then releases the valve 220, the spring in the valve 220 disrupts the communication between lines 214 and 226 by moving the piston to offset the passageway with lines 214 and 226. This offsetting discontinues air pressure on the actuator port 189 of the first pilot valve 180, thereby permitting its shifting once either of the buttons 120 or 130 is pushed.

To close the door, an operator pushes either close button 140 or 150. Because the structure and operation of the buttons 140 and 150 are substantially identical, only button 140 will be described. The button 140 has an inlet port 142 and outlet port 144. The button 140 also includes a spring and a piston having a passageway therethrough. The spring biases the piston to offset the passageway with the ports 142 and 144 to prevent air from the main air source 10 from reaching the second shuttle valve 170. Pressing the button 140 moves the piston, which compresses the spring, to align the passageway with the ports 142 and 144. This alignment permits air to travel from the line 141 through the line 145 to the second shuttle valve 170.

A safety feature of the invention requires that either the button 140 or 150 must be pressed to continue the closing of the door. The requirement of continued pressing is a result of a spring biasing the second pilot valve 190 (described herein).

The second shuttle valve 170 includes first and second inlet ports 171–172, and an outlet port 173. The air enters the inlet port 171 and forces a diaphragm within the valve 170 to block the inlet port 172. The air pulse then exits the outlet port 173 and enters the line 174. Due to the line 201 being blocked by the third pilot valve 200, which will be described herein, the air travels through the line 191 to the second pilot valve 190.

The passageway within the piston in the pilot valve 190 is aligned with the ports 196 and 197 when the spring is extended. The air entering the actuator port 192 from the main air source 10 shifts the valve 190 by applying pressure against the piston, which compresses the spring. The piston moves to align the passageway in the valve 190 with the lines 117 and 195. This alignment communicates the main air source 10 with the motor 300 to begin closing the door. Continued pressing of the button 140 maintains the alignment by sustaining air pressure on the piston. Releasing the button 140 stops the closing of the door by removing pressure on the piston. Once pressure on the piston is removed, the spring expands moving the piston to offset the passageway cutting off the supply of air to the motor 300.

Pressing the button 140 permits air from the main air source 10 to travel through the line 116 to the second regulating valve 270. The second regulating valve 270 has an inlet port 272 and an outlet port 274. After the air enters the inlet port 272, the valve 270 controls the pressure of the air exiting the outlet port 274. The air then travels from the outlet port 274 through the line 117 to the second pilot valve 190. The air enters the inlet port 194, passes through the passageway, and exits the valve 190 through the motor port 196. The air then travels to the motor 300 through the line 195. The air rotates the vanes in the motor 300 to close the door. The air exits the motor 300 through the line 185. The passageway in the first pilot valve 180 now aligns the line 185 with the line 188. The motor exhaust air enters the motor port 186, passes through the passageway, and exits the valve 180 through the exhaust port 187. The motor exhaust air then travels through the line 188 to the first flow control valve 240.

The first control valve 240 includes an inlet port 242 and an outlet port 244 and is adjustable to regulate the flow rate of the motor exhaust air. Adjusting the valve 240 creates a back pressure that controls the speed of the motor, and hence the closing speed of the door. Minimizing the pressure differential slows the closing of the door and stalls the motor 300 should the door strike an obstruction. The motor 300 stalls because the minimal pressure differential does not drive the door with sufficient force to crush the obstructing object. The motor exhaust air exits the outlet port 244 into the line 245 and then travels to the exhaust system 400.

As the door closes, the second drive shaft 312 rotates the chain 314 which, in turn, rotates the cam 302 via the third drive shaft 316. The second driveshaft 312, chain 314, third driveshaft 316, and cam 302 rotate in the opposite direction from that during opening. When the door reaches its fully closed position, an arm 321 of the cam 302 depresses the second cam valve 230.

The second cam valve 230 includes an inlet port 232 and an outlet port 234. The second cam valve 230 also includes a spring and a piston having a passageway therethrough. The spring biases the piston to offset the passageway within the valve 230 with respect to ports 232 and 234, thereby closing the line 216. When the door reaches its fully closed position, an arm 321 of the cam 302 depresses the valve 230. Depressing the valve 230 moves the piston, which compresses the spring, to align the passageway within the valve 230 with the lines 216 and 236. This alignment permits air from the pilot air source 210 to travel through the lines 212 and 216 to the third pilot valve 200.

The third pilot valve 200 includes an inlet port 202, an exhaust port 207, and an actuator port 209. The third pilot valve 200 also includes a spring and a piston having a passageway therethrough. The spring biases the piston to offset the passageway with lines 201 and 207. During closing of the door, this offset blocks the line 201. The air from the pilot air source 210 enters the valve 200 through the actuator port 209 and applies pressure against the piston, which compresses the spring. The piston moves to align the passageway in the valve 200 with the lines 201 and 208. The air from the main air source 10, instead of maintaining pressure on the actuator port 192 of the second pilot valve 190, now travels through the line 201. The air then enters the inlet port 202, passes through the passageway in the valve 200, exits the outlet port 207, and passes through the line 208 to the exhaust system 400.

The alignment of the line 201 to the exhaust system 400 releases the pressure on the actuator port 192. The spring in the second pilot valve 190 shifts the piston within the valve 190 to disrupt the communication between the lines 116 and 195 by aligning the passageway with the lines 195 and 198. This disruption stops the motor 300 by blocking its supply of air from the main air source 10.

The line 174 will be routed through line 201 to the atmosphere until the either of the open buttons 120 or 130 is pressed. Pressing the buttons 120 and 130 rotates the cam 302, thereby releasing the second cam valve 230 by moving the arm 321. Once the arm 321 releases the valve 230, the spring in the valve 230 disrupts the communication between lines 216 and 236 by moving the piston to offset the passageway with lines 216 and 236. This offsetting discontinues air pressure on the actuator port 209 of the third pilot valve 200. Once this pressure is disrupted, the spring in the third pilot valve 200 extends disrupting the communication between the lines 201 and 208 by moving the piston to offset the passageway with these lines 201 and 208. The door then opens as previously described, and once the door is fully opened, the door closes as previously described.

Figure 4:
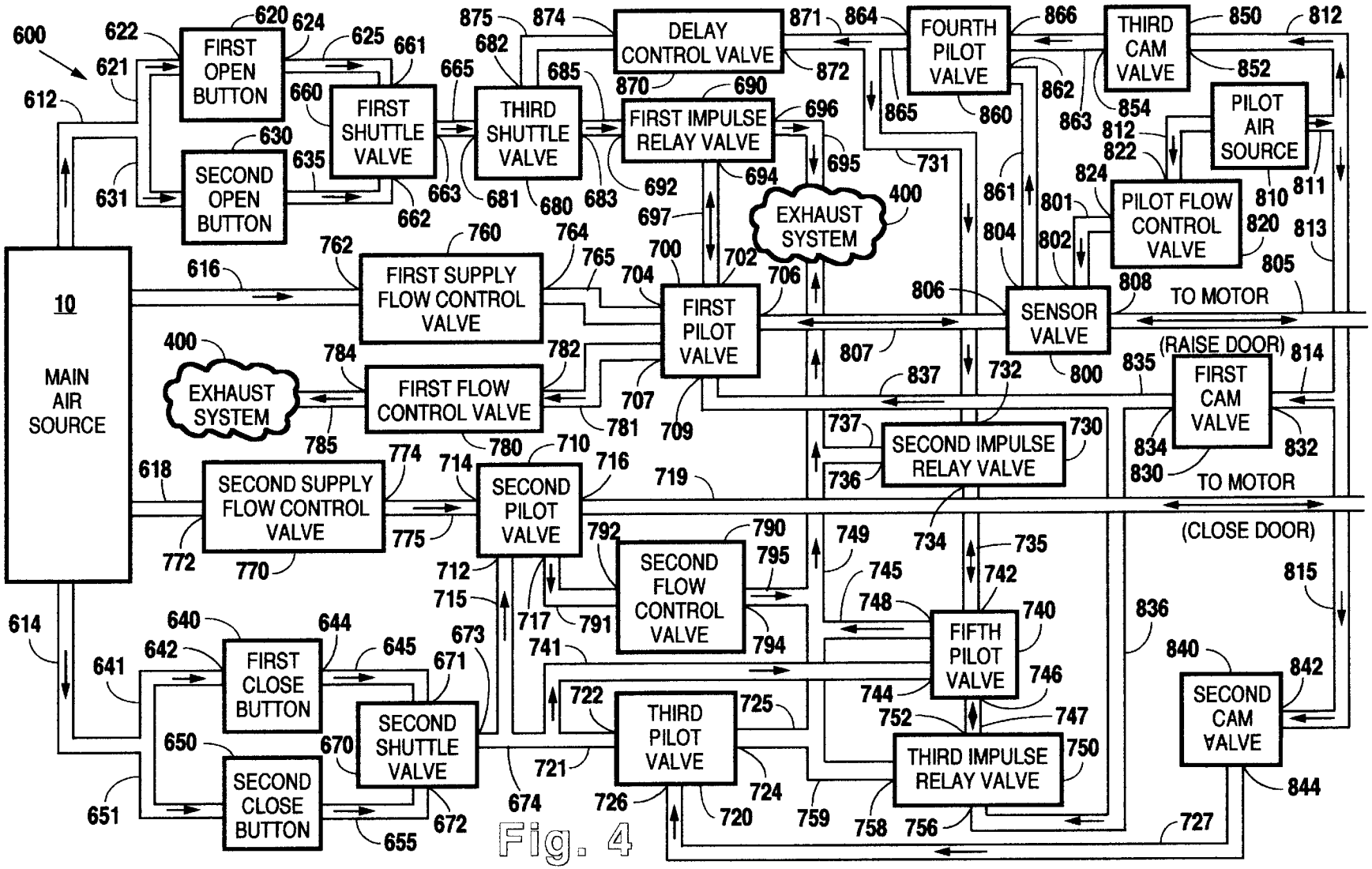
FIG. 4 is a block diagram illustrating a second preferred embodiment of the control system for the pneumatic door opener.

As illustrated in FIG. 4, a second embodiment of a control system 600 includes a first open button 620, a second open button 630, a first close button 640, a second close button 650, a first shuttle valve 660, a second shuttle valve 670, and a third shuttle valve 680. The buttons 620, 630, 640, and 650 are preferably push-button operated valves of the type REXROTH H894040-9902 manufactured by Rexroth, P.O. Box 13597, Lexington, Ky. 40512-3701. The first shuttle valve 660, the second shuttle valve 670, and the third shuttle 680 are preferably REXROTH P54350-2 valves manufactured by Rexroth, P.O. Box 13597, Lexington, Ky. 40512-3701.

The control system 600 also includes a first impulse relay valve 690, a second impulse relay valve 730, a third impulse relay valve 750, a first flow control valve 780, a second flow control valve 790, a first pilot valve 700, a second pilot valve 710, a third pilot valve 720, a fourth pilot valve 860, and a fifth pilot valve 740. The impulse relay valves 690, 730, and 750 are preferably 414B Pressure Type valve manufactured by Mead, 4114 N. Knox Ave., Chicago, Ill. 60641. Preferably, the pilot valves 700, 710, 720, 860, and 740 are, respectively, REXROTH GT10050-333-P69191-1, GT 10050-3340-P69191-1, GC 15000-3355, GC 15000-3355, GC 15000-333 valves manufactured by Rexroth, P.O. Box 13597, Lexington, Ky. 40512-3701. The flow control valves 780 and 790 are preferably MMS-25 valves manufactured by Meade, 4114 N. Knox Ave., Chicago, Ill. 60641.

In addition, the control system 600 includes a first supply control valve 760, a second supply flow control valve 770, a delay control valve 870, and an air regulator valve 820. The supply control valves 760 and 770 are REXROTH GT 10050-3333-P69191-1 and GT 10050-3340-P69191-1 valves manufactured by Rexroth, P.O. Box 13597, Lexington, Ky. 40512-3701. The delay control valve 870 is MEAD #MF1-12 manufactured by Mead, 4114 N. Knox Ave., Chicago, Ill. 60641. The air regulator valve 820 is R161G ARROW valve manufactured by Mead, 4114 N. Knox Ave., Chicago, Ill. 60641.

The control system 600 further includes a first cam valve 830, a second cam valve 840, a third cam valve 850, and a sensor valve 800. The cam valves 830, 840, and 850 are REXROTH HH-563260-000 valves preferably manufactured by Rexroth, P.O. Box 13597, Lexington, Ky. 40512-3701. The sensor valve 800 is Legris 7808-20-14 valve manufactured by Legris, Inc., 7205 E. Hampton Ave., Mesa, Ariz. 85208.

Referring to FIG. 2, the motor 300 is modified for use with the control system 600. The first cam valve 830 replaces the first cam valve 220 for activation by the arm 320 of the cam 302. The second cam valve 840 and the third cam valve 850 replace the second cam valve 230 for activation by the arm 321 of the cam 302. The line 185 is replaced by a line 805, the line 226 is replaced by a line 835, the line 195 is replaced by a line 719, and the line 236 is replaced by a line 727 (described herein with reference to FIG. 4). A further modification is adding a line 863 to communicate with the third cam valve 850.

The buttons 620 and 630, the first shuttle valve 660, the third shuttle valve 680, the first impulse relay valve 690, and the first pilot valve 700 activate the opening of the door. The first open button 620 and the second open button 630 are respectively positioned inside and outside of the enclosed structure, such as a garage. A line 612 branches into lines 621 and 631 that connect the main air source 10 with button 620 and 630. Lines 625 and 635 connect respective buttons 620 and 630 to the first shuttle valve 660. A line 665 connects the first shuttle valve 660 with the third shuttle valve 680. A line 685 connects the third shuttle valve 680 with the first impulse relay valve 690 and a line 875 connects the third shuttle valve 680 with the delay control valve 870 (described herein). A line 695 connects the impulse relay valve 690 with the exhaust system 400. A line 697 connects the first impulse relay valve 690 with the first pilot valve 700.

Several lines connect the first pilot valve 700 to the other components of the control system 600. A line 765 connects the first pilot valve 700 with the first supply flow control valve 760 which, in turn, communicates with the main air source 10 via a line 616. The first supply flow control valve 760 controls the pressure of the air received by the first pilot valve 700 from the main air source 10. A line 807 communicates with the motor 300 for facilitating the supply of air to and receipt of air from the motor 300. A line 781 connects the pilot valve 700 to the first flow control valve 780. The flow control valve 780 regulates the closing rate of the door by controlling the exhaust rate of the air from the motor 300. A line 785 connects the first flow control valve 780 to the exhaust system 400.

Lines 811, 813, and 814 stop the opening of the door, reset the control system 600 for closing, and connect a pilot air source 810 with the first cam valve 830. The pilot air source 210 is preferably air, although other gases may be used. The first cam valve 830 connects to the line 835 that branches into lines 837 and 836. The line 837 communicates the first cam valve 830 with the first pilot valve 700. The opening of the valve 830 delivers air to the pilot valve 700 thereby stopping the door (described herein). The line 836 communicates with the third impulse relay valve 750 that sends a signal to the fifth pilot valve 740 through a line 747 permitting the closing of the door (described herein).

The buttons 640 and 650, the second shuttle valve 670, and the second pilot valve 710 activate the closing of the door. The first closed button 640 and the second closed button 650 are respectively positioned inside and outside of the enclosed structure. A line 614 branches into lines 641 and 651 to connect the main air source 10 with the buttons 640 and 650. Lines 645 and 655 connect respective buttons 640 and 650 to the second shuttle valve 670. The line 674 branches into the line 715 to connect the second shuttle valve 670 with the second pilot valve 710. Similarly, the line 674 branches into lines 721 and 741 to respectively connect the second shuttle valve 670 with the third pilot valve 720 and the fifth pilot valve 740 for stopping the closing of the door (described herein).

Several lines connect the second pilot valve 710 with other components of the control system 600. A line 775 connects the second pilot valve 710 to the second supply flow control valve 770 which, in turn, communicates with the main air source 10 via a line 618. The second supply flow control valve 770 controls the pressure of the air received by the second pilot valve 710 from the main air source 10. The line 719 connects the pilot valve 710 to the motor 300 for facilitating the supply of air to and receipt of air from the motor 300. A line 791 connects the second pilot valve 710 to the second flow control valve 790 for controlling the flow of air exiting the motor 300 during opening. A line 795, in turn, connects the second flow control valve 790 to the exhaust system 400 via a line 749.

To stop the closing of the door, the second cam valve 840 and the third cam valve 850 are activated. Lines 811, 813, and 815 communicate the second cam valve 840 with the pilot air source 810. A line 727 connects the valve 840 to the third pilot valve 720. A line 725 connects the valve 720 to the line 749 which, in turn, connects to the exhaust system 400 for exhausting air from the line 674 (described herein).

The third cam valve 850, which sends a signal to prevent the reversal of the door when it reaches the ground, communicates with the pilot air source 810 via the lines 812 and 811. The line 863 connects the third cam valve 850 with the fourth pilot valve 860. Lines 861, 865, 731, and 871 communicate the fourth pilot valve 860 with the sensor valve 800, the second impulse relay valve 730, and the delay control valve 870.

The line 861 connects the fourth pilot valve 860 with the sensor valve 800. Lines 807 and 805 respectively communicate the sensor valve 800 with the first pilot valve 700 and the motor 300. A line 801 connects the sensor valve 800 with the air regulator valve 820 which, in turn, connects to the pilot air source 810 via the line 812.

The line 865 branches into the lines 871 and 731 that respectively connect the fourth pilot valve 860 with the delay control valve 870 and the second impulse relay valve 730. As previously described, the line 875 connects the delay control valve 870 with the third shuttle valve 680. A line 735 connects the second impulse relay valve 730 to the fifth pilot valve 740 and a line 737 connects the second impulse relay valve 730 with the line 729 which, in turn, connects to the exhaust system 400.

As previously described, the fifth pilot valve 740 communicates with the line 674 via the line 741 and the line 747 connects the fifth pilot valve 740 with the third impulse relay valve 750. A line 745 connects the fifth pilot valve 740 to the exhaust system 400 via the line 749.

As previously described, the third impulse relay valve 750 communicates with the first cam valve 830 via the lines 836 and 835. A line 759 connects to the third impulse relay valve 750 to the line 749, which, in turn, connects to the exhaust system 400.

To open the door, an operator pushes either button 620 or 630. Because the structure and operation of the buttons 620 and 630 are substantially identical, only the button 620 will be described. The button 620 has an inlet port 622 and outlet port 624. The button 620 also includes a spring and a piston having a passageway therethrough. The spring biases the piston to offset the passageway with the ports 622 and 624 preventing air from the air source 10 from reaching the first shuttle valve 660. Pressing the button 620 moves the piston, which depresses the spring to align the passageway with the inlet port 622 and the outlet port 624. After release of the button 620, the spring expands moving the piston to offset the passageway relative to the ports 622 and 624, thereby closing the line 621. An air pulse from the line 621 travels through the line 625 to the first shuttle valve 660. The first shuttle 660 includes first and second inlet ports 661 and 662 and an outlet port 663. The air pulse enters the inlet port 661 and forces a diaphragm within the valve 660 to block the inlet port 662. The air pulse then exits the outlet port 663 to travel to the third shuttle valve 680 through the line 665. The third shuttle valve 680 includes first and second inlet ports 681-682 and an outlet port 683. The air pulse enters the inlet port 681 and forces a diaphragm within the valve 680 to block the inlet port 682. The air pulse then exits the outlet port 683 to travel to the first impulse relay valve 690 through the line 685.

The first impulse relay valve 690 includes an inlet port 692, an actuator port 694, and an exhaust port 696. The impulse relay valve 690 includes a piston having a passageway therethrough. The air pulse enters the inlet port 692 and exits through the actuator port 694 to activate the first pilot valve 700. Almost simultaneously, the air pulse builds pressure within the valve 690 to open an internal spring-loaded valve. Opening the spring-loaded valve permits a slipstream from the air pulse to shift the piston, thereby aligning the passageway with the lines 697 and 695. This alignment permits air to exhaust from the line 697 to the exhaust system 400, and thereby eliminating any back pressure on the first pilot valve 700. The air pulse then travels through the line 697 to shift the pilot valve 700.

The first pilot valve 700 includes a first actuator port 702, an inlet port 704, a motor port 706, an exhaust port 707, and a second actuator port 709. The first pilot valve 700 also includes a piston having a passageway therethrough. The air pulse enters the pilot valve 700 through the actuator port 702 shifting the piston to align the passageway with the ports 704 and 706. This alignment communicates the main air source 10 with the motor 300 for opening the door. Because the piston of the valve 700 is unbiased by any mechanism, such as a spring, momentarily depressing either button 620 or 630 aligns the passageway with the ports 704 and 706.

Aligning the passageway in the first pilot valve 700 permits air from the main air source 10 to travel through the line 616 to the first supply flow control valve 760. First supply flow control valve 760 has an inlet port 762 and an outlet port 764. After the air enters the inlet port 762, the valve 760 controls the pressure of the air exiting the outlet port 764. The air then travels from the outlet port 764 through the line 765 to the first pilot valve 700. Due to the alignment of the passageway with the ports 704 and 706, air travels through the first pilot valve 700 and the line 807 to the sensor valve 800.

The sensor valve 800 has a pilot port 806 and a motor port 808. The air enters the pilot port 806 of the sensor valve 800 and exits through the motor port 808. The air then enters the line 805 from the motor port 808 to travel to the motor 300. The air from the line 805 enters the motor 300 to turn the vanes for raising the door. Subsequently, the air exits the motor 300 to travel to the second pilot valve 710.

The second pilot valve 710 includes an actuator port 712, an inlet port 714, a motor port 716 and an exhaust port 717. The second pilot valve 710 also includes a spring and a piston having a passageway therethrough. The spring biases the piston to align the passageway with ports 716 and 717. During the opening of the door, air supplied to the motor 300 through the line 805 exhausts through the line 719. The motor exhaust air from the line 719 enters the motor port 716 of the valve 710, travels through the passageway, and exits through the exhaust port 717. The motor exhaust air then travels through the line 791 to the second flow control valve 790.

The second flow control valve 790 includes an inlet port 792 and an outlet port 794. The motor exhaust air enters the inlet port 792 and exits the outlet port 794. The second flow control valve 790 is adjustable to regulate the flow rate of the motor exhaust air. Controlling the flow rate of the motor exhaust air regulates the speed of the motor vanes, and thereby controls the opening rate of the door. The exhaust air travels from the exhaust port 794 through the lines 795 and 749 to the exhaust system 400.

As the door opens, the second drive shaft 312 rotates the chain 314 which, in turn, rotates the cam 302 via the third drive shaft 316. As a result, the positioning of the cam 302 corresponds to the positioning of the door as it opens. Once the door has reached its fully open position, an arm 320 of the cam 302 presses the first cam valve 830, thereby activating it.

The first cam valve 830 includes an inlet port 832 and an outlet port 834. The first cam valve 830 also includes a spring and a piston having a passageway therethrough. The spring biases the piston to offset the passageway with respect to the ports 832 and 834, thereby closing the line 814. Once the door fully opens, the arm 320 depresses the valve 830 moving the piston, which compresses the spring, to align the passageway with the ports 832 and 834. This alignment permits air from the pilot air source 810 to travel through the lines 811, 813, and 814 to the line 835 through the passageway in the first cam valve 830. The pilot air then splits to travel through the line 836 to reach the third impulse relay valve 750 and through the line 837 to reach the first pilot valve 700.

The third impulse relay valve 750 includes an inlet port 756, an actuator port 752, and an exhaust port 758. The third impulse relay valve 750 further includes a piston having a passageway therethrough. The air from the first cam valve 830 enters the inlet port 756 and exits through the actuator port 752 en route to the fifth pilot valve 740. The air positions the fifth pilot valve 740 to block the line 741, thereby permitting the closing of the door (described herein).

After entering the inlet port 756, the air almost simultaneously builds pressure within the valve 750 to open an internal spring-loaded valve. opening the internal spring-loaded valve permits a slipstream from the pilot air to shift the piston, thereby aligning the passageway with the lines 747 and 759. This alignment permits air to exhaust from the line 747 to the exhaust system 400, thereby eliminating any back pressure on the fifth pilot valve 740.

After the air exits the actuator port 752 of the third impulse relay valve 750, the air travels through the line 747 to the fifth pilot valve 740. The fifth pilot valve includes a first actuator port 742, an inlet port 744, a second actuator port 746, and an exhaust port 748. The fifth pilot valve 740 also includes a piston having a passageway therethrough. The air applies pressure at the second actuator port 746 to position the piston by offsetting the passageway to block the line 741. Blocking the line 741 prevents air in the line 674 from escaping to the exhaust system 400.

The other portion of the pilot air stream from the line 835 enters the first pilot valve 700 through the second actuator port 709. The air entering the port 709 shifts the first pilot valve 700 to disrupt the communication between the lines 765 and 807 by shifting the piston to align its passageway with the lines 807 and 781. This shifting of the piston shuts off the supply of air to the motor 300, thereby stopping it, and aligns the line 807 with the exhaust system 400. The shifting of the valve 700 also forces out air within the line 697. Air from the line 697 enters the actuator port 694 of the first impulse relay valve 690, exits through the exhaust port 696, and travels through the line 695 to the exhaust system 400. A slipstream taken from the forced air shifts the piston to disrupt the communication between the lines 697 and 695 by aligning the passageway within the piston with the lines 685 and 697.

The positioning of the door corresponds to the positioning of the cam 302 that continues to depress the valve 830 with the arm 320, thereby sending air to the actuator port 709 of the first pilot valve 700. By maintaining pressure on the actuator port 709, this positioning prevents further opening of the door if either of the buttons 620 or 630 is accidentally pressed. Once either of the closed buttons 640 or 650 is pushed, the cam 302 rotates moving the arm 320. The arm 320 then releases the valve 830. The spring in the valve 830 disrupts the communication between the lines 814 and 835 by moving the piston to offset the passageway with the lines 814 and 835. This offsetting discontinues air pressure on the actuator port 709 of the first pilot valve 700, thereby permitting shifting of the piston within the valve 700 once either the buttons 620 or 630 is pushed.

To close the door, an operator pushes either close button 640 or 650. Because the structure and operation of the buttons 640 and 650 are substantially identical, only button 640 will be described. The button 640 has an inlet port 642 and an outlet port 644. The button 640 also includes a spring and a piston having a passageway therethrough. The spring biases the piston to offset the passageway with the ports 642 and 644 to prevent air from the main air source 10 from reaching the second shuttle valve 670. Pressing the button 640 moves the piston, which compresses the spring, to align the passageway with the ports 642 and 644. This alignment from the line 641 allows air to reach the second shuttle valve 670 through the line 645. A safety feature of the invention requires that either button 640 or 650 must be pressed to continue closing of the door. The requirement of continued pressing is a result of a spring biasing the second pilot valve 710 (described herein).

The second shuttle valve 670 includes a first and second inlet ports 671–672, and an outlet port 673. The air enters the inlet port 671 and forces a diaphragm within the valve 670 to block inlet port 672. The air then exits the outlet port 673 and enters the line 674. Due to the lines 721 and 741 being blocked respectively by the third pilot valve 720 (described herein) and the fifth pilot valve 740, the air travels from the line 715 to the second pilot valve 710.

The passageway within the piston of the pilot valve 710 is aligned with the ports 719 and 717 when the spring is extended. The air entering the actuator port 712 from the main air source 10 shifts the valve 710 by applying pressure against the piston, which compresses the spring. The piston moves to align the passageway in the valve 710 with the lines 775 and 719. This alignment communicates the main air source 10 with the motor 300 to begin closing the door. Continuing pressing of the button 640 maintains the alignment by sustaining air pressure on the piston. Releasing the button 640 stops the closing of the door by removing pressure on the piston. Once pressure on the piston is removed, the spring expands moving the piston to offset the passageway with the lines 775 and 719, thereby cutting off the supply of air to the motor 300.

Pressing the button 640 permits air from the main air source 10 to travel through the line 618 to the second supply flow control valve 770. The second supply flow control valve 770 has an inlet port 772 and an outlet port 774. After the air enters the inlet port 772, the valve 770 controls the pressure of the air exiting the outlet port 774. The air then travels from the outlet port 774 through the line 775 to the second pilot valve 710. The air enters the inlet port 714, passes through the passageway, and exits the valve 710 through the motor port 716. The air then travels to the motor 300 through the line 719. The air then rotates the vanes in the motor 300 to close the door. The air exits the motor 300 through the line 805 to the sensor valve 800.

The sensor valve 800 sends a signal to stop and reverse the door should it strike an object (described herein). The air from the line 805 enters the sensor valve 800 through the motor port 808 and exits through the pilot valve 806. The air exiting the sensor valve 800 enters the line 807 which, in turn, communicates with the first pilot valve 700. The passageway in the first pilot valve 700 now aligns the line 807 with the line 781. The motor exhaust air enters the motor port 706, passes through the passageway, and exits the valve 700 through the exhaust port 707. The motor exhaust air then travels through the line 781 to the first flow control valve 780.

The first control valve 780 includes an inlet port 782 and an outlet port 784, and is adjustable to regulate the flow rate of the motor exhaust air. Adjusting the valve 780 creates a back pressure that controls the speed of the motor vanes and, as a result, the closing speed of the door. The motor exhaust air exits the outlet port 784 into the line 785 and then travels to the exhaust system 400.

If the door should strike an object, the sensor valve 800 sends a signal to stop and reverse the door. Besides the pilot port 806 and the motor port 808, the sensor valve 800 further includes a pilot inlet port 802 and a pilot outlet port 804. The sensor valve 800 also includes a piston/diaphragm combination that separates the exhaust pressure from the pilot pressure. In this preferred embodiment, when the exhaust pressure drops to 10 percent of the pilot pressure, the pilot pressure is allowed to go out the pilot outlet port 804. This is typically referred to as a 10 to 1 ratio, although other ratios of exhaust pressure to pilot pressure may be used. If an obstruction of the door occurs, the exhaust pressure from the motor 300 drops, causing the diaphragm within the sensor valve to shift permitting air from the pilot air source 810 to flow through the sensor valve 800 to the fourth pilot valve 860. Air traveling from the air source 810 reaches the air regulator valve 820 through the line 812.

The pilot flow control valve 820 has an inlet port 822 and outlet port 824. The pilot flow control valve 820 stabilizes the pressure of the air exiting the pilot air source 810. The pilot flow control valve 820 and second supply flow control valve 700 respectively stabilize the air pressure of the motor air during closing and the pilot air flowing to the sensor valve 800. This stabilization prevents accidental door stoppage and reversal during closing due to pressure fluctuations in the air supply.

Air exits the outlet port 824 of the pilot flow control valve 820 and enters the line 801. The pilot air then enters the pilot inlet port 802 of the sensor valve 800. The air travels through the sensor valve 800 and exits the pilot outlet port 804. The air then travels through the line 861 to the fourth pilot valve 860.

The fourth pilot valve 860 includes an inlet port 862, an outlet port 864, and a disruption port 866. The fourth pilot valve 860 also includes a spring and a piston having a passageway therethrough. The spring biases the piston to align the passageway with the ports 862 and 864. The pilot air from the line 893 enters the inlet port 862 of the valve 860, travels through the passageway, and exits through the outlet port 864. The pilot air then travels through the line 865. The line 865 branches into the lines 871 and 731 that respectively communicate with the third control valve 870 and the second impulse relay valve 730. These lines 871 and 731 split the pilot air to stop and reverse the closing of the door.

Part of the pilot air from the line 865 travels through the line 731 to the second impulse relay valve 730 for stopping the closing of the door. The second impulse relay valve 730 includes an inlet port 732, an actuator port 734, and an exhaust port 736. The second impulse relay valve 730 also includes a piston having a passageway therethrough. The pilot air enters the inlet port 732 and exits through the actuator port 734 to activate the fifth pilot valve 740. Almost simultaneously, the air builds pressure within the valve 730 to open an internal spring-loaded valve. Opening the spring-loaded valve permits a slipstream from the pilot air to shift the piston thereby aligning the passageway with the lines 735 and 737. This alignment exhausts air from the line 735 to the exhaust system 400, thereby eliminating any back pressure on the fifth pilot valve 740. After exiting the second impulse relay valve 730, the air travels through the line 735 to shift the fifth pilot valve 740.

The fifth pilot valve 740 includes a first actuator port 742, an inlet port 744, a second actuator port 746, and an exhaust port 748. The fifth pilot valve 740 also includes a piston having a passageway therethrough. This piston offsets the passageway to block the line 741. The pilot air enters the pilot valve 740 through the actuator port 742 shifting the piston. The shifting of the piston forces air in the line 747 toward the third impulse relay valve 750 and aligns the passageway within the piston with the ports 744 and 748.

The air in the line 747 enters the actuator port 752 of the third impulse relay valve 750, exits through the exhaust port 758, and travels through the line 759 to the exhaust system 400. A slipstream taken from the forced air shifts the piston to disrupt the communication between the lines 747 and 759 by aligning the passageway within the piston with the lines 836 and 747. This alignment resets the third impulse relay valve 750 for closing the door. When the door is in the fully opened position, the arm 320 of the cam 302 depresses the valve 830. The resulting pilot air signal passes through the third impulse relay valve 750 to the fifth pilot valve 740, thereby positioning a piston within the fifth pilot valve 740 to block the line 741. This positioning of the piston permits closing of the door.

The alignment of the passageway in the fifth pilot valve 740 with the ports 744 and 748 communicates the line 674 that supplies air to the second pilot valve 710 with the exhaust system 400. Thus the air, instead of maintaining pressure on the second pilot valve 710, travels from the line 674 to the line 741. From the line 741, the air enters the fifth pilot valve 740 through the inlet port 744, travels through the passageway, and exits through the exhaust port 748. The air travels through the lines 745 and 749 to the exhaust system 400. This diversion of air from the actuator port 712 of the second pilot valve 710 removes pressure from the piston permitting its spring to expand.

The expansion of the spring in the second pilot valve 710 shifts the piston within the valve 710 to disrupt the communication between the lines 775 and 719 by aligning the passageway with lines 719 and 791. This disruption stops the motor 300 by blocking its supply of air from the main air source 10 and, as a result, stops the door.

Almost simultaneously with the stopping of the door, the other part of the pilot air from the line 865 travels through the line 871 to the delay control valve 870 for reversing the door. The delay control valve 870 has an inlet port 872 and an outlet port 874. The delay control valve 870 provides a delay to prevent the reversal of the door upon reaching its fully closed position (described herein). The pilot air exits the outlet port 874 and enters the line 875. The pilot air then travels through the line 875 to the third shuttle valve 680.

The pilot air enters the inlet port 682 of the third shuttle valve 680 and forces the diaphragm within the valve 680 to block the other inlet port 681. The air then exits the outlet port 683 to travel to the impulse relay valve 690 through the line 685.

As previously described, the first impulse relay valve 690 sends a signal to the first pilot valve 700 to communicate the motor 300 with the main air source 10 for opening the door and simultaneously disrupting the communication between the line 807 and the motor exhaust line 781. These actions result in the reversal of the door and reset the control system 600 for closing the door once it is fully opened. The fully opened door closes as previously described.

If the door does not hit an obstruction during closing, the second drive shaft 312 continues to rotate the chain 314 which, in turn, rotates the cam 302 via the third drive shaft 316. The second drive shaft 312, chain 314, third drive shaft 315 and cam 302 rotate in the opposite direction from that during opening. When the door reaches its fully closed position, an arm 321 of the cam 302 depresses the second cam valve 840 and the third cam valve 850.

The second cam valve 840 includes an inlet port 842 and an outlet port 844. The second cam valve 840 also includes a spring and a piston having a passageway therethrough. The spring biases the piston to offset the passageway with the valve 840 with respect to ports 842 and 844, thereby closing the line 815. When the door reaches its fully closed position, an arm 321 of the cam 302 depresses the valve 840. Depressing the valve 840 moves the piston, which compresses the spring to align the passageway within the valve 840 with the lines 815 and 727. This alignment permits air from the pilot air source 810 to travel through the lines 815 and 727 to the third pilot valve 720.

The third pilot valve 720 includes an inlet port 722, an exhaust port 724, and an actuator port 726. The third pilot valve 720 also includes a spring and a piston having a passageway therethrough. The spring biases the piston to offset the passageway with the lines 721 and 725. During closing of the door this offset blocks the line 721. The air from the pilot air source 810 enters the valve 720 through the actuator port 726 and applies pressure against the piston which compresses the spring. The piston moves to align the passageway in the valve with the lines 721 and 725. The air from the main air source 10 instead of maintaining pressure on the piston of the second pilot valve 710, now travels through the line 721. The air enters the inlet port 722, passes through the passageway in the valve 720, and exits the outlet port 724, and passes through the lines 725 and 749 to the exhaust system 400. Once the pressure is removed on the piston, the spring of the second pilot valve 710 shifts the piston within the valve 710 to disrupt the communication between the lines 775 and 719 by aligning the passageway with the lines 719 and 717. This disruption stops the motor 300 by blocking its supply of air from the main air source 10.

To prevent the door from reversing upon reaching the ground, the cam 302 simultaneously depresses the third cam valve 850 along with the second cam valve 840. The third cam valve 850 includes an inlet port 852 and an outlet port 854. The third cam valve 850 also includes a spring and a piston having a passageway therethrough. The spring biases the piston to offset the passageway within the valve 850 with respect to ports 852 and 854, thereby closing the line 812. When the door reaches the ground, an arm 321 of the cam 302 depresses the valve 850. Depressing the valve 850 moves the piston, which compresses the spring, to align the passageway within the valve 850 with the lines 812 and 863. This alignment permits air from the pilot air source 810 to travel through the lines 812 and 863 to the fourth pilot valve 860.

The air from the pilot air source 810 enters the disruption port 866 of the fourth pilot valve 860. The spring within the fourth pilot valve 860 normally aligns the inlet port 862 with the outlet port 864. The air compresses the spring within the valve 860 to offset the passageway with respect to lines 861 and 865. This offset prevents a signal from the sensor valve 800 from reaching the other components of the control system 600 for stopping and reversing the door. Due to varying line lengths in the control system 600, the signal from the third cam valve 850 to stop the door from reversing upon closing may not reach the fourth pilot valve 860 quickly enough. If a signal to reverse the door is accidentally sent, the delay control valve 870 can be adjusted to require a longer, stronger signal from the sensor valve 800 to permit door reversal.

The line 674 will be routed through the line 721 to the exhaust system 400 and the passageway within the fourth pilot valve 860 will be offset until either of the open buttons 630 or 620 is pressed. Pressing the button 620 or 630 rotates the cam 302, thereby releasing the second cam valve 840 and the third cam valve 850 by moving the arm 321.

Once the arm 321 releases the valve 840, its spring expands disrupting the communication between the lines 815 and 727 by moving its piston to offset the passageway with lines 815 and 727. This offsetting discontinues air pressure on the actuator port 726 of the third pilot valve 720. Once this pressure is disrupted, the spring in the third pilot valve 720 extends disrupting the communication between lines 721 and 725 by offsetting the passageway within the piston.

Once the arm 321 releases the valve 850, its spring expands disrupting the communication between the lines 812 and 863 by moving the piston to offset the passageway with the lines 812 and 863. This offsetting discontinues air pressure on the disruption port 866 of the fourth pilot valve 860. Once this pressure is disrupted, the spring in the fourth pilot valve 860 extends aligning the passageway within the piston to establish communication between the lines 862 and 865. The door now opens as previously described.

From the foregoing description and illustration of this invention it is apparent that various modifications may be made by reconfigurations or combinations producing similar results. It is, therefore, the desire of the applicant not to be bound by the description of this invention as contained in this specification, but be bound only by the claims as appended hereto.

We claim:

1. A door opener, comprising:

a pressurized gas source;

a pneumatic motor coupled to a door;

a first pilot valve coupled to the pressurized gas source wherein the first pilot valve in a first position delivers pressurized gas to the pneumatic motor, thereby driving the pneumatic motor to raise the door, and the first pilot valve in a second position couples the pneumatic motor to an exhaust system;

a first pneumatic actuator coupled between the pressurized gas source and the first pilot valve wherein, when actuated, the pneumatic actuator delivers pressurized gas to the first pilot valve, thereby placing the first pilot valve in its first position; and a first cam valve coupled to the pressurized gas source wherein, when the door is fully raised, the first cam valve delivers pressurized gas to the first pilot valve, thereby placing the first pilot valve in its second position.

2. The door opener according to claim 1, further comprising:

a second pilot valve coupled to the pressurized gas source wherein the second pilot valve in a first position delivers pressurized gas to the pneumatic motor, thereby driving the pneumatic motor to lower the door, and the second pilot valve in a second position couples the pneumatic motor to the exhaust system;

a second pneumatic actuator coupled to the pressurized gas source wherein, when actuated, the second pneumatic actuator delivers pressurized gas to the second pilot valve, thereby placing the second pilot valve in its first position;

a third pilot valve coupled to the pressurized gas source wherein the third pilot valve in a first position permits the second pneumatic actuator to deliver pressurized gas to the pneumatic motor, and the third pilot valve in a second position couples the second pneumatic actuator to the exhaust system, thereby preventing the second pneumatic actuator from delivering pressurized gas to the pneumatic motor; and a second cam valve coupled to the pressurized gas source wherein, when the door is fully lowered, the second cam valve delivers pressurized gas to the third pilot valve, thereby placing the third pilot valve in its second position.

3. The door opener according to claim 2, further comprising a second regulating valve positioned between the pressurized gas source and the second pilot valve for regulating the delivery of pressurized gas to the second pilot valve.

4. The door opener according to claim 2, further comprising a second flow control valve positioned between the second pilot valve and the exhaust system for controlling the rate at which the door opens.

5. The door opener according to claim 2, wherein the second pneumatic actuator comprises:

a close button valve coupled to the pressurized gas source; and a second shuttle valve coupled to the open button valve for delivering pressurized gas to the second pilot valve upon the depression of the close button.

6. The door opener according to claim 2, further comprising a second cam coupled to the pneumatic motor wherein the second cam tracks the position of the door and actuates the second cam valve when the door is fully lowered.

7. The door opener according to claim 2, further comprising a pneumatic safety actuator that senses for the door striking an object during its lowering and that stops and raises the door upon the sensing an object was struck.

8. The door opener according to claim 7 wherein the pneumatic safety actuator comprises:

a fourth pilot valve coupled to the pressurized gas source wherein the fourth pilot valve in a first position prevents the delivery of pressurized gas, and the fourth pilot valve in a second position permits the delivery of pressurized gas;

a fifth pilot valve coupled to the fourth pilot valve and the second pneumatic actuator wherein the fifth pilot valve in a first position permits the second pneumatic actuator to deliver pressurized gas to the pneumatic motor, and the fifth pilot valve in a second position couples the second pneumatic actuator to the exhaust system, thereby preventing the second pneumatic actuator from delivering pressurized gas to the pneumatic motor; and a sensor valve positioned between the pneumatic motor and the first pilot valve wherein, when the sensor valve senses the door strike an object during its lowering, the sensor valve places the fourth pilot valve in its second position, whereby the fourth pilot valve delivers pressurized gas to the fifth pilot valve to place the fifth pilot valve in its second position, and the fourth pilot valve delivers pressurized gas to the first pilot valve to place the first pilot valve in its first position that delivers pressurized gas to the pneumatic motor, thereby driving the pneumatic motor to raise the door.

9. The door opener according to claim 8 wherein the pneumatic safety actuator further comprises a third shuttle valve coupled to the fourth pilot valve for delivering pressurized gas to an impulse relay valve of the first pneumatic actuator.

10. The door opener according to claim 9 wherein the pneumatic safety actuator further comprises a delay control valve positioned between the fourth pilot valve and the third shuttle valve for preventing the reversing of the door upon it reaching its fully lowered position.

11. The door opener according to claim 8 wherein the pneumatic safety actuator further comprises a third cam valve positioned between the pressurized gas source and the fourth pilot valve wherein, when the door is fully lowered, the third cam valve prevents the delivery of pressurized gas to the fourth pilot valve.

12. The door opener according to claim 11, further comprising a third cam coupled to the pneumatic motor wherein the third cam tracks the position of the door and actuates the third cam valve when the door is fully lowered.

13. The door opener according to claim 1, further comprising a first regulating valve positioned between the pressurized gas source and the first pilot valve for regulating the delivery of pressurized gas to the first pilot valve.

14. The door opener according to claim 1, further comprising a first flow control valve positioned between the first pilot valve and the exhaust system for controlling the rate at which the door closes.

15. The door opener according to claim 1, wherein the first pneumatic actuator comprises:

an open button valve coupled to the pressurized gas source;

a first shuttle valve coupled to the open button valve wherein the depression of the open button valve delivers pressurized gas to the first shuttle valve; and an impulse relay valve coupled to the first shuttle valve for delivering pressurized gas to the first pilot valve, thereby placing the first pilot valve in its first position.

16. The door opener according to claim 15 wherein the pressurized gas delivered to the impulse relay valve couples the impulse relay valve to the exhaust system upon the placing of the first pilot valve in its first position.

17. The door opener according to claim 1, further comprising a first cam coupled to the pneumatic motor wherein the first cam tracks the position of the door and actuates the first cam valve when the door is fully raised.

* * * * *